United States Patent [19]

Birk

[11] 4,292,488

[45] Sep. 29, 1981

[54] MICROWAVE OVEN DOOR HAVING A CONFORMABLE SCREEN

[75] Inventor: Earl Birk, Sioux Falls, S. Dak.

[73] Assignee: Litton Systems, Inc., Beverly Hills, Calif.

[21] Appl. No.: 162,983

[22] Filed: Jun. 25, 1980

[51] Int. Cl.[3] ..... H05B 6/76

[52] U.S. Cl. ..... 219/10.55 D; 126/200; 219/10.55 R

[58] Field of Search ..... 219/10.55 D, 10.55 R, 219/10.55 C, 10.55 F; 126/273 R, 198, 190, 200

[56] References Cited

U.S. PATENT DOCUMENTS

| | | | |
|---|---|---|---|
| 3,304,401 | 2/1967 | Long | 219/10.55 D |
| 3,666,904 | 5/1972 | Krajewski | 219/10.55 D |
| 3,879,595 | 4/1975 | Lamb | 219/10.55 D |
| 3,985,993 | 10/1966 | Imberg et al. | 219/10.55 D |
| 4,008,383 | 2/1977 | Tanaka et al. | 219/10.55 D |
| 4,049,939 | 9/1977 | Katona | 219/10.55 D |
| 4,081,647 | 3/1978 | Torrey | 219/10.55 D |
| 4,206,338 | 6/1980 | Katona | 219/10.55 D |

*Primary Examiner*—Arthur T. Grimley
*Attorney, Agent, or Firm*—Robert E. Lowe

[57] ABSTRACT

A microwave oven having a door configured to minimize the leakage of microwave energy is disclosed. The door includes a flat sheet of glass and a flexible metal screen substantially overlying the glass sheet. The glass and the metal screen are held in substantially coplanar relationship in a frame. The edges of the metal screen are deformed such that the mounting of the metal screen in the frame causes the central portion of the metal screen to bow away from the glass. When the door is closed the metal screen conforms to the oven front panel.

7 Claims, 5 Drawing Figures

MICROWAVE OVEN DOOR HAVING A CONFORMABLE SCREEN

BACKGROUND OF THE INVENTION

This invention relates to the field of microwave oven doors, and more specifically to that class of microwave oven doors which are especially adapted to minimize the leakage of microwave energy at the oven-door interface.

For reasons of energy conservation, as well as compliance with government regulation, it is desirable to insure that microwave energy introduced into an oven cavity does not leak out. In fact, government standards set limits of maximum allowable energy emissions.

It has long been recognized that in many cases microwave oven leakage can be minimized by providing a close fit between the oven door and the front face of the oven. Ordinary manufacturing tolerances will cause unacceptable gaps to exist which will cause excessive leakage unless special measures are taken.

In the past such measures have included spring urged plates mounted in the door to force the plate into contact with the oven front when the door is closed. Other techniques have included the use of compressible gaskets or other elastic substances which allow the door to be pressed into a tight fit with the oven front.

Considerations of appearance and cost have dictated substantial changes in the construction of microwave oven doors in recent years. Modern consumer microwave ovens are typically constructed with a wide expanse of glass across virtually the entire door area. Accordingly, the door interior is no longer constructed of metal and the use of spring loaded metal contact plates or collars is no longer practical.

As illustrated in U.S. Pat. No. 3,843,859 to Eldon J. Klemp and Vernon Cassibo more modern microwave oven doors are constructed using a sheet of glass having a perforated metal sheet or screen laminated to the glass. This construction may also include a sheet of plastic, such as Mylar or Lexan, laminated over the metal screen. In this construction the metal screen is generally attached to the glass in a rigid manner, such as by gluing it directly to the glass. Because glass is a relatively inflexible material there is little opportunity in this construction for the inner surface of the door to conform itself to the shape or irregularities of the oven front panel.

SUMMARY OF THE INVENTION

The present invention overcomes the shortcomings of the prior art by providing a microwave oven door construction having the esthetic appearance of a modern glass door and at the same time providing improved energy leakage suppression characteristics.

The present invention provides a microwave oven door having a frame into which is mounted a sheet of glass, a perforated metal screen and a sheet of plastic. The sheets of glass, metal, and plastic are essentially coplanar and are mounted with the glass outermost followed by the metal screen with the plastic sheet innermost toward the oven front panel. The peripheral edges of the metal screen are offset with the offset portion positioned within the frame of the door during assembly. The frame exerts a lever action against the offset portion, causing the central portion of the metal screen to buckle away from the glass. In this manner the metal screen is caused to be separated by a small distance from the glass across most of its surface area. When the door is closed the metal screen is deformed to align itself with the general shape and irregularities of the oven front panel.

BRIEF DESCRIPTION OF THE DRAWINGS

The invention will be explained in greater detail by reference to the accompanying drawings in which.

DESCRIPTION OF PREFERRED EMBODIMENTS

Figure 1:
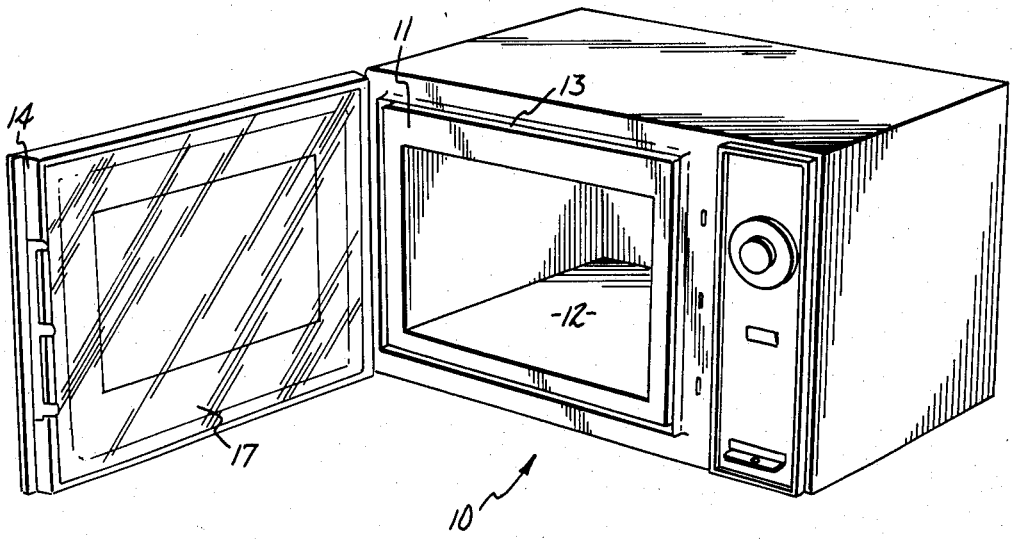
FIG. 1 is a front perspective view of a microwave oven having a door of the present invention.

In the drawings FIG. 1 illustrates a microwave oven having a door of the type utilized in the present invention. The microwave oven 10 shown in FIG. 1 includes a front panel 11 and a cooking cavity 12. Lying within the front panel 11 is a choke 13 which is specifically dimensioned and placed so as to absorb microwave energy emitted from the cavity. The choke can be of any design known in the art, but typically will have a depth equal to approximately one fourth of the wave length of microwave energy used in the oven, and most commonly will be filled with some type of inert material such as polypropylene. It will be understood that it is not necessary in the present invention that the choke by physically located in the front panel 11. Alternatively the choke can be located in the door frame 14 in a manner well known in the art.

Figure 2:
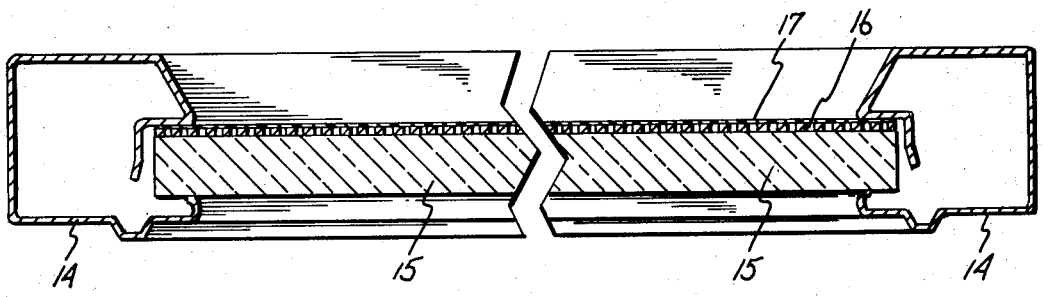
Prior Art Fig. 2
FIG. 2 is a cross sectional view of a microwave oven door of the type found in the prior art.

FIG. 2 illustrates the prior art construction of the laminated type oven door. Such doors consist of a frame 14 into which is placed a sheet of glass 15 having laminated to it a perforated metal sheet or screen 16 and a layer of plastic 17, such as Mylar or Lexan. The metal screen 16 and plastic sheet 17 are substantially flat and coplanar with the glass sheet 15. The metal screen 16 is generally bonded to the glass sheet 15 by means of an adhesive. In some constructions of this type of door the adhesive layer may be placed only around the periphery of the screen if desired. However in either type of construction the metal screen lies generally in close contact with the glass sheet across substantially its entire surface area.

Figure 5:
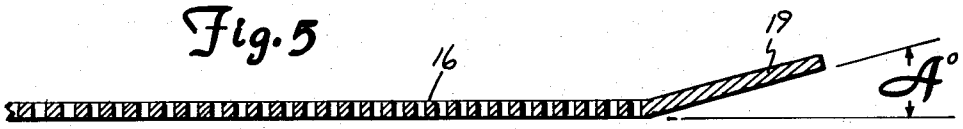
FIG. 5 is a partial cross section of the screen used in the present invention showing the edge offset feature.

In the microwave oven door of the present invention the metal screen 16 has been substantially modified, as shown best in FIG. 5. An offset portion is incorporated into the peripheral edge of the screen 16. This can be accomplished in a variety of ways but it is preferred to form a bend in the edge of the screen as illustrated at 19.

Figure 3:
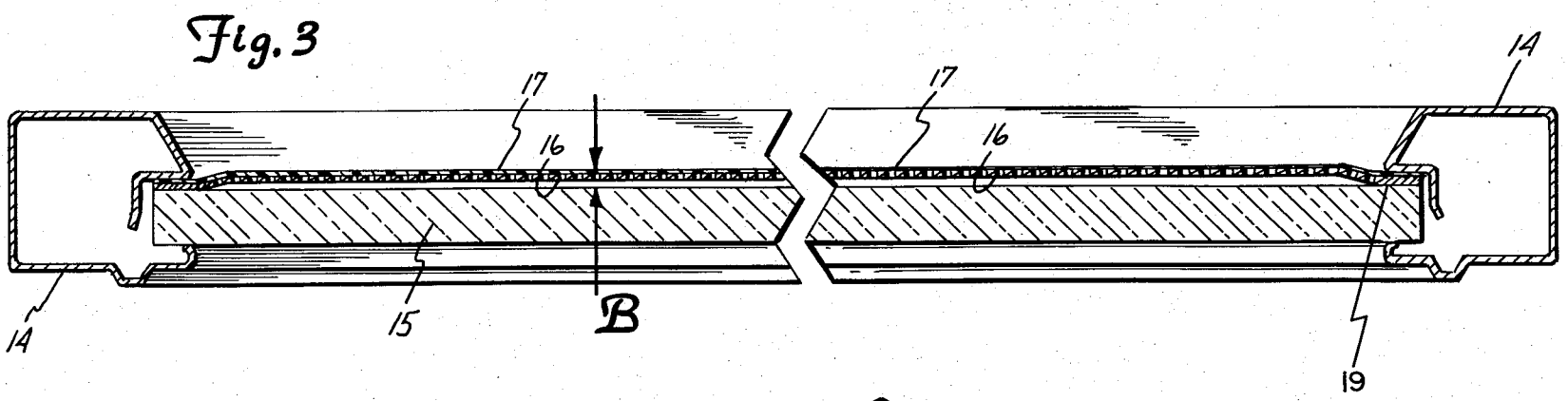
FIG. 3 is a cross sectional view of a microwave oven door incorporating the present invention.

In the drawings an angle A is indicated between the horizontal and the offset portion 19. This angle may be on the order of approximately 10° to 30°, with an angle of about 15° generally giving good results. However it should be understood that the angle itself is not a critical parameter in the present invention. Rather the more important dimension is that shown by distance B in FIG. 3 which is the distance between the screen and the glass when the door is in an assembled condition. This distance should be on the order of 0.015 inches to 0.100 inches for best results.

Accordingly the angle A can be varied depending on the length of offset portion 19 relative to the total surface area of the screen 16. The angle may also be dependent upon the precise method of mounting the screen and the glass into the frame 14. If the angle A is reduced to smaller than about 10° it is likely that there will be insufficient leverage on the screen 16 to cause it to bow sufficiently across its entire surface. On the other hand if the angle A exceeds about 10° it is likely that sufficient bowing will be produced but at the expense of introducing unnecessary stress levels in the metal screen at the offset portion.

The door frame 14 may be a molded, rollformed, or extruded part and will include a channel 20 for receiving the other door components. The door is assembled by placing the glass 15 the metal screen 16 and the plastic sheet 17 into the channel 20 in frame 14 such that the glass forms the outermost surface of the door and the metal screen lies inwardly of the glass toward the oven front panel 11. The plastic sheet 17 overlies the metal screen 16 and serves the primary function of improving the cleanability of the door interior by providing a smooth unbroken surface. This prevents food particles and splatters from lodging in the perforations in the metal screen 16.

The screen 16 is laid upon the glass with the offset portions extending away from the glass. As the glass screen and plastic sheet are pressed into the channel 20, the offset portion 19 is caused to flattened against the glass through the pressure of the frame 14. As the offset portion 19 is flattened against the glass the central planar portion of the metal screen is caused to bow or buckle away from the glass, as shown most clearly in FIG. 3. In effect, the central planar portion of the metal screen 16 is allowed to "float" free of the glass surface.

Figure 4:
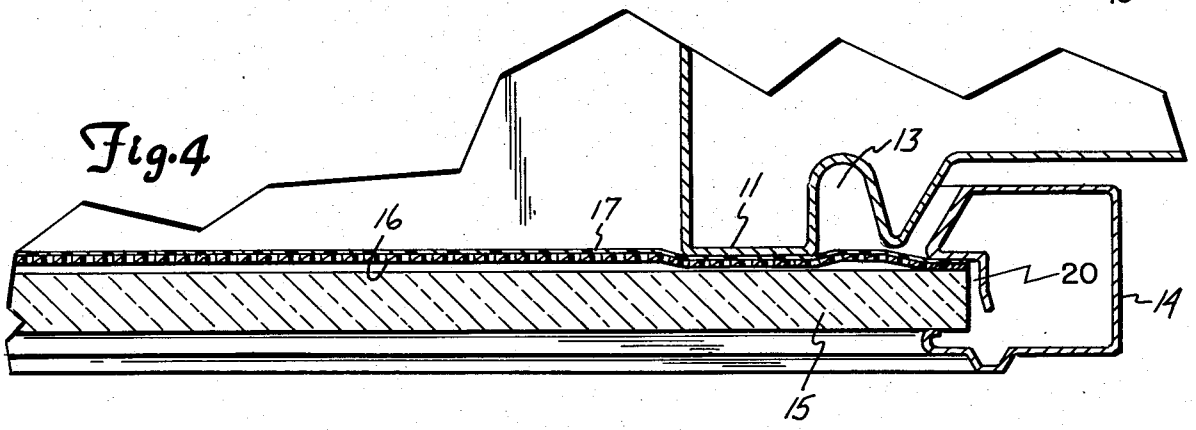
FIG. 4 is a partial cross section showing the microwave oven door of the present invention in the closed position.

The operation of the metal screen can best be seen in FIG. 4 which depicts the oven door in a closed position. As illustrated therein, as the door is tightly closed the metal screen 16 is caused to deform in those areas in which it makes contact with the front panel 11. Since the metal screen is free of contact with the glass in that area it is deformable and can conform to the contours of the front panel throughout all areas of contact between the two surfaces. In this manner a much tighter fit around the entire periphery of the front panel is obtained than is possible with the old prior art doors having the metal screen rigidly bonded to the glass.

In the prior art construction it was necessary that the entire front panel be held to very strict manufacturing tolerances in terms of flatness in order to insure a proper fit between the door and the front panel. In the present invention these tolerances can be substantially relaxed and compensated for because of the ability of the free floating screen to conform itself to the irregularities, if any, in the oven front panel 11. The close fit thus achieved greatly reduces the leakage of microwave energy from the cavity 12.

Thus the present invention provides a simple, cost effective means of improving the leakage characteristics of modern microwave oven doors, while at the same time allowing their pleasing appearance and esthetics to remain.

While in the foregoing specification the invention has been explained in considerable detail, it will be understood that such detail is provided for the purpose of complete illustration and is not intended to unduly limit the scope of the invention.

Having thus described the invention what is claimed is:

1. A microwave oven door comprising a frame, a sheet of substantially flat glass mounted in said frame, said frame substantially encircling said glass, a flexible metal screen overlying and substantially coplanar with said sheet of glass and mounted in said frame, the edges of said screen being deformed away from the general plane of said screen, said deformed edges extending into said frame; whereby the compression of said deformed edges of said screen by said frame causes said screen to bow away from said glass.

2. In a microwave oven having a door configured to reduce the leakage of microwave energy from the oven-door interface area when the door is closed, said oven including a front panel portion, an improved door construction comprising:

(a) a substantially flat glass sheet sized to cover substantially the entire front of said oven, the peripheral portions of said glass sheet extending across said front panel portion, (b) a conductive metal screen having substantially equal height and width dimensions as said glass sheet and mounted adjacent said glass sheet between said sheet and said front panel portion, said metal screen having a peripheral offset portion, (c) a frame encircling said glass sheet and said metal screen and holding them in close contact at their respective peripheral edges, whereby the action of said frame against said offset portion causes said metal screen to bow away from said glass sheet across substantially all of the area of said screen not in contact with said frame, whereby said screen conforms to said front panel portion when said door is closed.

3. The apparatus of claim 2 wherein said metal screen is bowed away from said glass sheet a distance of about 0.015 inches to about 0.100 inches at the center of said screen.

4. The apparatus of claim 2 further comprising a choke portion in said front panel portion, said metal screen contacting said front panel portion inwardly of said choke portion.

5. The apparatus of claim 2 further comprising a sheet of nonconductive plastic having substantially equal height and width dimensions as said glass sheet and said metal screen, said plastic sheet mounted in said frame positioned between said metal screen and said front panel portion.

6. The apparatus of claim 3 wherein said sheet of nonconductive plastic is adhesively bonded to said metal screen.

7. A microwave oven having a door configured to minimize the leakage of microwave energy past the oven-door interface when the door is closed, said oven including:

(a) a cavity having a front panel, (b) a door frame hinged to said oven to close across said front panel, (c) a sheet of substantially flat glass mounted at its peripheral edges in said frame, (d) a substantially flat, flexible metal screen mounted at its peripheral edges in said frame on the oven side of said glass sheet, said screen including an offset edge portion which when clamped into said frame causes the remaining free portion of said screen to bow away from said glass sheet, whereby said metal screen is enabled to substantially conform to the shape of said front panel when said door is closed.

* * * * *